United States Patent [19]

Weingrad

[11] 3,982,882

[45] Sept. 28, 1976

[54] METHOD AND APPARATUS FOR PREPARING TEST SPECIMENS SUBJECTED TO DIFFERENT HEAT TREATMENTS

[75] Inventor: Saul Weingrad, Hillsdale, N.J.

[73] Assignee: Commercial Decal, Inc., Mount Vernon, N.Y.

[22] Filed: May 19, 1975

[21] Appl. No.: 578,814

[52] U.S. Cl. ..... 432/5; 432/43; 432/57; 432/126

[51] Int. Cl.[2] ..... F27D 5/00; F27B 9/40

[58] Field of Search ..... 432/5, 43, 57, 126; 73/15 R

[56] References Cited

UNITED STATES PATENTS

| | | | |
|---|---|---|---|
| 1,227,027 | 5/1917 | Baily et al. | 432/43 |
| 1,697,129 | 1/1929 | McCann | 432/126 X |

FOREIGN PATENTS OR APPLICATIONS

| | | | |
|---|---|---|---|
| 355,839 | 9/1931 | United Kingdom | 432/126 |

*Primary Examiner*—John J. Camby

*Attorney, Agent, or Firm*—Lerner, David, Littenberg & Samuel

[57] ABSTRACT

A furnace for preparing test specimens, such as specimens of ceramic materials, is provided, such furnace including a furnace chamber having a heating zone; heating means for heating the heating zone; first specimen support means disposed in the heating zone supporting at least two test specimens to be subjected to heat treatment; heat sensing means disposed in the heating zone for sensing the degree of heat treatment of at least one of said test specimens; specimen outlet conveyor means for removing from the heating zone at least one test specimen subjected to a predetermined heat treatment; and specimen inlet conveyor means for feeding control or blank specimens into the heating zone to maintain constant the total number (total mass) of specimens subjected to heat treatment in the heating zone. In a preferred embodiment, the specimen inlet and outlet conveyor means are adapted to cause the specimens to be moved about a predetermined path in the heating zone after the specimens are subjected to a predetermined heat treatment so as to allow the removal of at least one of the test specimens and the feeding of a corresponding number of control specimens onto the first specimen support means. In this manner, the total number and mass of specimens, including actual test specimens and control specimens, in the heating zone will be constant, from start to finish. Preferably, the control specimens should have the same heat absorption properties as the test specimens. In addition, it is also preferable to pre-heat the control specimens to the temperature of the heating zone before they are fed into the heating zone to more accurately duplicate conditions in the furnace.

A method of preparing a plurality of test specimens employing the above apparatus is also provided, which method includes the steps of feeding at least first and second test specimens to be heat treated into a heating zone, subjecting said test specimens to a first predetermined heat treatment, removing said first test specimen from said heating zone, said first test specimen representing a specimen subjected to said first predetermined heat treatment, substantially simultaneously feeding a control specimen into the heating zone to replace said first test specimen, thereby maintaining constant the total number and total mass of specimens present in the heating zone, subjecting said second test specimen and said control specimen remaining in the heating zone to a second predetermined heat treatment, and removing said second test specimen from the heating zone, said second test specimen representing a specimen subjected to said first heat treatment under the same conditions as was said first test specimen and also subjected to said second predetermined heat treatment.

17 Claims, 5 Drawing Figures

74 (OPERATES FLUID SUPPLY 72 TO LOWER PISTON CYLINDERS 56 & 58)
76
BINARY COUNTER
200
214
216
210
212
SECOND DIFFERENTIAL AMPLIFIER
206
208
NON-LINEAR DIGITAL TO ANALOGUE CONVERTER
218
220
FIRST DIFFERENTIAL AMPLIFIER
202
204
DELAY LINE
226
224
222
74 (TO RAISE TS AND PISTON CYLINDERS 56 & 58)
96
100
102
TO THERMOCOUPLE 32
LS-1

METHOD AND APPARATUS FOR PREPARING TEST SPECIMENS SUBJECTED TO DIFFERENT HEAT TREATMENTS

FIELD OF INVENTION

The present invention relates to a furnace for preparing test specimens, such as specimens of ceramic materials, and to a method of preparing such test specimens employing such furnace.

BACKGROUND OF THE INVENTION

Many materials, such as ceramic, are subjected to a heat treatment to attain desired characteristics thereof in the finished article. Accordingly, it is common practice to prepare test specimens of such materials to subject them to different heat treatments to accurately determine the effect of various heat treatments on the material. A number of methods and a variety of apparatus have been employed for preparing and studying such test specimens. In one such method, a series of identical test specimens are prepared, and each specimen is heat treated, in turn, at differing temperatures in a suitable furnace having means for varying the amount of heat applied; the heat attained during the firing period of each specimen is recorded and the series of fired specimens are studied to determine the one test specimen giving most nearly the desired results. Commercial production would then proceed upon the basis of firing to the temperature that was observed for the best of the test specimens.

It has been found that the above procedure many times is not adequate to determine the best specimen and the best firing temperature. For example, it is indeed possible that the optimum firing temperature may be missed if only a few specimens at widely varying temperatures are tested. Furthermore, with such methods it is difficult to determine the temperature actually attained in the specimen as distinguished from the temperature of the recording point in the furnace. This difficulty exists whether the heat treatment is in such a low range that measurement may be accomplished with mercury thermometers or in such a high range requiring platinum alloy thermocouples or the like as measuring devices. The reason for this difficulty is that there exists within the furnace and within the test specimen itself a temperature gradient in all directions, and the gradient will change in character as the maximum firing temperature is varied. Even though the measuring device may be applied directly to the face of the test specimen, there remains an element of uncertainty as to whether any part of the specimen is at a different temperature than is the surface. In addition, the measuring device may itself conduct away more or less heat depending upon its mass and conductivity, and thus influence the observed temperature at the measuring point. Another disadvantage of the abovedescribed test method is the relatively long time involved in separately testing a large series of specimens.

In an attempt to overcome the loss of time involved in separate testing of individual specimens, a method was developed which involved subjecting an elongated specimen to a varying gradient of temperature from a high value at one end, to a low value at the other end. This was accomplished in a so-called tube furnace, which in its common form comprises a ceramic tube of convenient length having wound thereon a heating coil of heavy duty electrical resistance wire, both the tube and winding being surrounded in turn by heavy thermal insulation to minimize any lateral heat loss. The effect of such an arrangement is to create a maximum temperature at the longitudinal center of the tube, with a gradual drop toward room temperatures at both exposed ends of the tube. In order to measure the temperature gradient, a thermocouple is mounted upon a rod which could be moved into the tube from above the specimen to hold the thermocouple at measured distances from the outer end long enough to obtain a stabilized reading. A temperature curve may be drawn from the several readings and then compared with the observed results of the firing along the length of the specimen. While this method assured a continuous record of firing results between the extremes of temperature from one end of the specimen to the other, there still remained a lack of assurance that observed temperatures corresponded with sufficient accuracy to those actually existing in the specimen at the various measured distances from the end. U.S. Pat. No. 2,825,222 to Stone attempted to overcome the problems associated with the latter method by providing apparatus for determining the actual temperatures in every portion of the elongated sample. Such apparatus is disclosed as including an elongated ceramic rod adapted to be placed in a tube-shaped furnace chamber. The elongated rod includes an upper surface shaped to closely engage specimens of materials placed thereon and further includes a series of temperature responsive elements mounted so as to be adjacent the upper surface of the rod.

Unfortunately, all of the prior art apparatus and techniques for preparing and studying test specimens subjected to different heat treatments suffer from the same fundamental disadvantages. This disadvantage resides in the fact that the series of specimens are not tested under identical conditions since the test specimens are not subjected to the same heat treatments at the same time. As a result, the test specimens produced do not accurately reflect the effects of different firing temperatures on the test specimens since many other variables effect the test specimens when they are tested at different times. For example, in the first prior art method discussed above wherein separate ceramic specimens are fired one at a time at different temperatures, the heat treatment to which each of the specimens is subjected have no common basis or reference for purposes of comparison as the specimens are fired at different times. In addition, each of these specimens are not heated in a heating zone or furnace which is heated to the same temperature throughout which also results in further varying of conditions and inaccurate test results. The Stone technique and apparatus is similar in this regard in that different areas of the heating zone or furnace are heated to different temperatures.

All heat treatment includes basically two factors, namely, the temperature at which a specimen is heated and the time that such specimen is heated at such temperature. The prior art technique wherein separate specimens are heated one at a time at different temperatures does not reflect the time that the samples are heated at each different temperature. The same holds true for the technique disclosed in the Stone patent.

The apparatus and method of the present invention overcome the disadvantages associated with the prior art apparatus and techniques and employs a furnace or heating zone which is heated at a uniform temperature throughout, and always contains the same number and- /or mass of specimens so that each specimen removed from the furnace has been heated to all of the temperatures and under the same firing conditions to which the previously removed samples have been subjected.

BRIEF DESCRIPTION OF THE INVENTION

In accordance with the present invention, there is provided a furnace for preparing test specimens of materials, such as any type of materials which are normally subjected to heat treatment during their use and are subject to degradation or deterioration or maturation from such heat treatment. For example, such materials include paints, plastics, insulation such as normally employed on electrical wires, ceramic materials, glassware, pottery materials, aluminum enamel and the like. The furnace of the invention includes a furnace chamber having a heating zone therein, heating means for uniformly heating the heating zone to a desired temperature, first specimen support means disposed in the heating zone for supporting at least two test specimens to be subjected to heat treatment, heat sensing means, such as a thermocouple, disposed in the heating zone for sensing the degree of heat treatment of at least one of the test specimens, specimen outlet conveyor means for removing from the heating zone at least one test specimen subjected to a predetermined heat treatment, and specimen inlet conveyor means for feeding control specimens into the heating zone to maintain constant the total number of specimens subjected to heat treatment in such heating zone.

In a preferred embodiment, the furnace further includes a cooling zone disposed in the furnace chamber and insulated from the heating zone. The cooling zone includes second specimen support means for supporting control specimen in storage and test specimens previously subject to heat treatment. Preferably, the control specimens should have the same heat absorption properties as the test specimens. In addition, it is also preferable to pre-heat the control specimens to the temperature of the heating zone before they are fed into the heating zone. These features operate to more accurately duplicate the conditions on each test specimen.

Preferably, the heat sensing means is a thermocouple which is in operative communication with the specimen outlet conveyor means and the specimen inlet conveyor means, and is adapted to control operation of such conveyor means in response to the heat sensing means sensing that a test specimen has been subjected to a predetermined heat treatment so that such test specimen may be removed from the heating zone and transferred to the cooling zone and control specimen may be removed from the cooling zone and transferred to the heating zone to replace the test specimen so removed. Thus, it will be appreciated that the furnace of the invention may be automated so that the heat sensing means is adapted to actuate a drive means for driving the specimen outlet conveyor means and the specimen inlet conveyor means in response to the heat treatment sensed by the heat sensing means. During the preparation of the test specimens employing the above furnace, the total number or mass of specimens undergoing heat treatment in the heating zone remains constant so that each test specimen removed from the heating zone is heated to all of the temperatures and under the same firing conditions to which the previously removed specimens have been subjected. Moreover, by filling the heating zone with specimens, a uniform heat distribution is brought about in the heating zone. In addition, the specimens themselves may be employed, in conjunction with the conveyor means, to move specimens through the heating zone and through the cooling zone.

In addition, in accordance with the present invention, a method of preparing a plurality of test specimens is provided which method may be carried out employing the furnace described above. The method of the invention includes the steps of feeding at least first and second test specimens into a heating zone, subjecting the test specimens to a first heat treatment, sensing that at least one of such test specimens has, in fact, undergone such first heat treatment, removing such first test specimen from the heating zone, feeding a first control specimen into the heating zone to replace the first test specimen, thereby maintaining constant the total number and mass of the specimens present in the heating zone and undergoing heat treatment, subjecting the second test specimen and the first control specimen to a second heat treatment, sensing that the second test specimen has been subjected to such heat treatment, and removing such second test specimen from the heating zone. The second test specimen represents a specimen subjected to the first heat treatment as well as the second heat treatment. As a result, the first and second test specimens have both been subjected to the same first heat treatment so that the variables and different conditions caused by heat treatments at different times are eliminated.

Each of the test specimens removed from the heating zone is transferred to a cooling zone wherein it is cooled. Furthermore, in a preferred embodiment of the method of the invention, the control specimens are stored in the cooling zone and are fed from the cooling zone to the heating zone to replace test specimens removed therefrom. Moreover, it is also preferable to pre-heat the control specimens to the temperature of the heating zone before they are fed into the heating zone.

The method of the invention can be conducted in carrying out at least two types of heat treatment, namely, heating a series of test specimens to various predetermined temperatures and observing the effect on each test specimen of such heat treatment. Alternatively, the method of the invention may be employed by subjecting the test specimen to heating at a predetermined temperature for various periods of time. Regardless of the type of heat treatment employed, in all aspects of the present method, all test specimens will be fired under substantially the same conditions with the mass or number of specimens being heated remaining constant throughout the successive heat treatments.

It will be appreciated that the furnace of the invention and the method of preparing test specimens therein can be conducted manually or automatically so that specimens undergoing heat treatment may be manually or automatically removed from the heating zone and transferred to a cooling zone, and control specimens may be manually or automatically removed from the cooling zone and transferred to the heating zone to maintain the number and/or mass of specimens in the heating zone constant at all times. In this manner, test specimens may be heated under the same firing conditions either at different temperatures and/or at the same temperature for different lengths of time, and each specimen removed from the heating zone will have undergone the same heat treatments as each of the previously removed specimens.

DETAILED DISCUSSION OF PREFERRED EMBODIMENTS OF THE INVENTION

Figure 1:
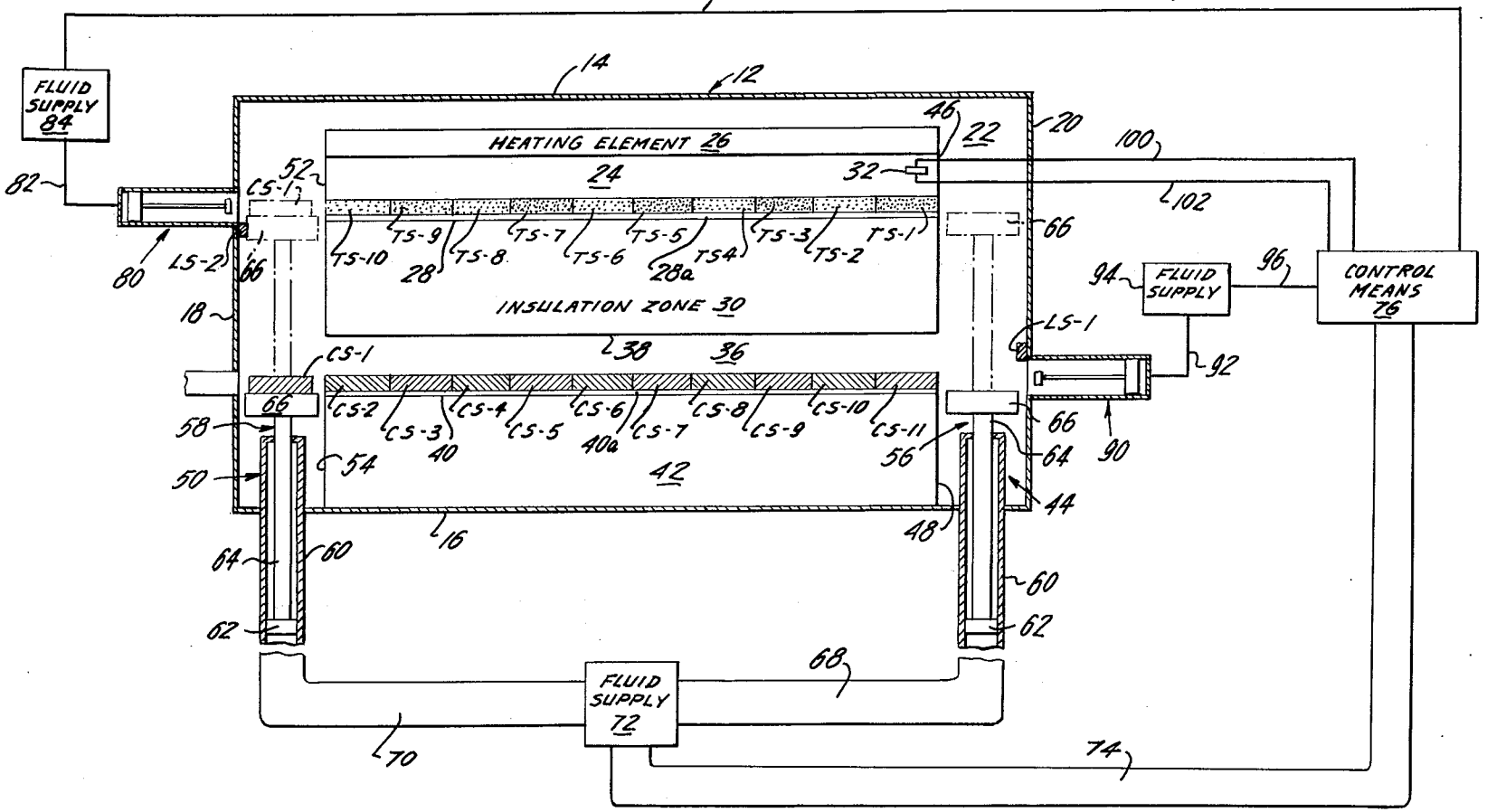
FIG. 1 is a schematic cross-sectional view of a furnace in accordance with the present invention showing the initial heat treatment of test specimens disposed in the heating zone and control specimens disposed in a cooling zone.

Referring to FIG. 1, there is shown a preferred embodiment of the furnace of the invention which is identified generally by the numeral 10. The furnace 10 includes a body or housing 12 formed of refractory bricks or other insulating material comprising a top wall 14 and a bottom wall 16, side walls 18 and 20, back wall 22, and a front wall broken away for drawing clarity.

The furnace 10 includes a heating zone 24 having heating means 26 disposed therein for uniformly heating the heating zone. The heating means may take the form of any conventional heating element which will uniformly heat the heating zone. An example of such a heating element may comprise one or more heating coils or bars connected to a source of electricity. As will be seen from the drawing, heating zone 24 is defined by side walls 46, 52, heating element 26 and the top wall 28 of an insulation zone 30. Top wall 28 also forms a first specimen support means, as will be explained. The insulation zone 30 may comprise a layer of refractory bricks which will insulate the heating zone from the area disposed below the insulation zone.

Heating sensing means 32, which may take the form of a conventional thermocouple is disposed in the heating zone 24 near side wall 46 of heating zone 24. Disposed below the insulation zone 30 is a cooling zone 36 which is defined by the bottom wall 38 of insulation zone 30 and a top wall 40 of a second specimen support means 42, as shown.

Specimen outlet conveyor means, generally indicated by the numeral 44, is movable between an upper position adjacent side wall 46 and a lower position adjacent one end 48 of top wall 40, and is adapted to remove a test specimen transferred from heating zone 24 and first specimen support means 28 and transfer it to cooling zone 36. Specimen inlet conveyor means, generally indicated by the numeral 50, is movable between an upper position adjacent side wall 52 and a lower position adjacent one end 54 of top wall 40. The specimen inlet conveyor means 50 is adapted for feeding control specimens from the cooling zone 36 and the second specimen support means 42 to the heating zone 24.

The first specimen support means 28 disposed in heating zone 24 preferably comprises a stationary first track or surface **28*a* extending between side walls 46, 52. The first track 28*a* is adapted to support a plurality of specimens including test specimens TS and/or control or blank specimens CS along the length of said first track as the specimens are subjected to heat treatment in the heating zone 24. The second specimen support means 42 disposed in the cooling zone 36 preferably comprises a second track 40*a* extending between the first and second end 48, 54, respectively, and is adapted to support a plurality of control or blank specimens CS and/or test specimens TS along the length of said second track for storing the control specimens and for cooling the test specimens previously subjected to heat treatment in heating zone 24. The first and second tracks 28*a*, 40*a*** may comprise stationary flat surface formed of a heat resistant material, such as a smooth-surfaced refractory slab or brick.

The specimen outlet conveyor means 44 and the specimen inlet conveyor means 50 preferably comprise first and second piston-cylinder arrangements 56, 58, respectively. Each of the first and second piston-cylinder arrangements 56, 58 includes a cylinder 60 in which a piston 62 is connected to a piston rod 64 and is adapted to ride. Each of the piston rods 64 include a support surface 66 at the end opposite the piston 62. Support surface 66 is employed for supporting a test specimen or a control specimen in the case of piston-cylinder arrangement 58. The cylinders 60 of the piston-cylinder arrangements 56 and 58 are connected via conduits 68 and 70, respectively, to a fluid supply source 72 such as an air supply or hydraulic liquid supply. The fluid supply 72 is in turn connected by means of conduits 74 to control means 76 described in detail below.

Figure 2:
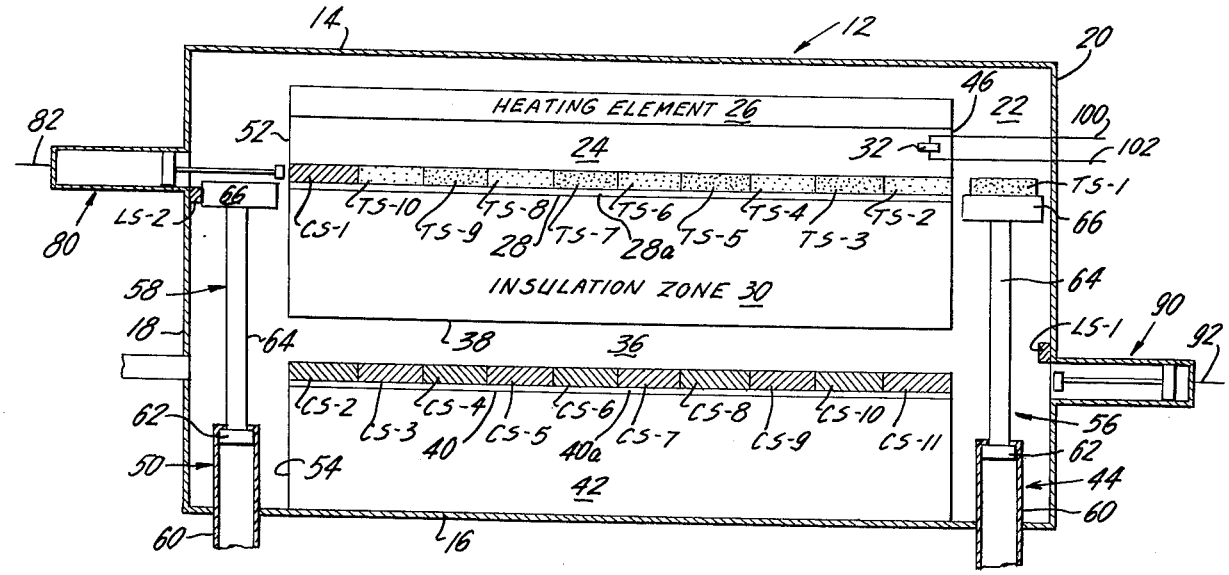
FIG. 2 is a view of a portion of the furnace shown in FIG. 1 wherein a control specimen has been removed from the cooling zone and transferred into the heating zone thereby displacing from the heating zone one test specimen which has undergone a predetermined heat treatment.
Figure 3:
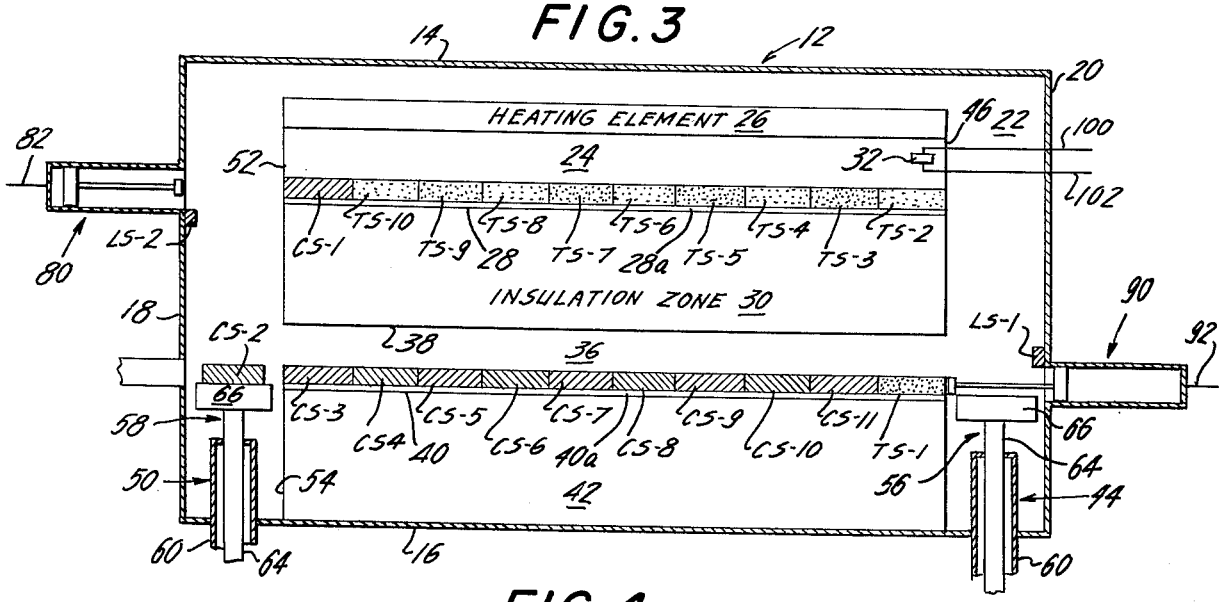
FIG. 3 is a view of a portion of the furnace shown in FIG. 1 wherein one test specimen which has undergone a predetermined heat treatment has been removed from the heating zone and transferred into the cooling zone, thereby displacing from the cooling zone a control specimen which is to be fed to the heating zone to replace the next test specimen to be removed from the heating zone.

A first ram device 80 which may take the form of a conventional piston-cylinder arrangement, as shown, is disposed in close proximity to side wall 52 of heating zone 24 and is adapted to move a control specimen CS from the support surface 66 of the second piston-cylinder arrangement 58 onto the first track **28*a* and into the heating zone 24, as shown in FIGS. 2 and 3. The first ram device 80 is connected by means of a conduit 82 to a fluid supply source 84 which in turn is connected by means of a conduit 86 to the control means 76**.

Figure 4:
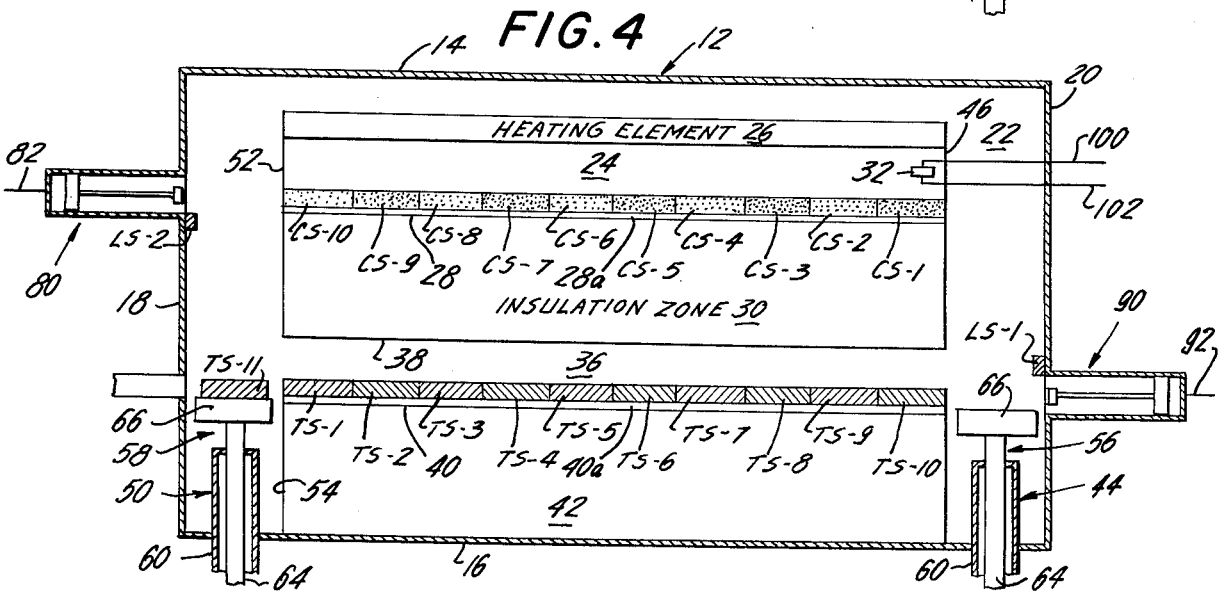
FIG. 4 is a view of a portion of the furnace in FIG. 1 wherein all of the test specimens have been subjected to heat treatment and have been removed to the cooling zone and control specimens have been removed from the cooling zone and transferred to the heating zone to replace such test specimens.

A second ram device 90 which may take the form of conventional piston-cylinder arrangement, as shown, is disposed in close proximity to the first end 48 of the second track **40*a* and is adapted to move a specimen from the support surface 66 of the first piston-cylinder arrangement 56 onto the second track 40*a* and into the cooling zone 36 as shown in FIG. 4 and as will be described in detail hereinafter. The second ram device 90 is connected by means of a conduit 92 to a fluid supply 94 which in turn is connected by means of a conduit 96 to the control means 76**.

The heat sensing means in the form of the thermocouple 32 is also connected by means of wires 100 and 102 to the control means 76.

It will now be appreciated that thermocouple 32 is adapted to actuate control means 76 which in turn causes movement of piston rods 64 and pistons 62 in the cylinders 60 thereby raising or lowering the specimens between the heating zone 24 and the cooling zone 36. Furthermore, thermocouple 32 is adapted to actuate control means 76 so as to control movement of the piston rods of the first and second ram devices 80 and 90 for removing a specimen from the support surface 66 of the piston-cylinder arrangements 56, 58 onto track 40*a* in cooling zone 36 and onto track 28*a* in heating zone 24 respectively. Furthermore, in a preferred embodiment of the present invention, control means 76 operates to raise or lower piston rods 64 of the piston-cylinder arrangements 56 and 58 simultaneously. In this manner, when the support surfaces 66 thereof are at their upper position near side walls 46, 52, ram device 80 automatically moves a control specimen CS from support surface 66 of second piston-cylinder arrangement 58 onto first track 28*a* thereby forcing a test specimen TS from the first track 28*a* onto the support surface 66 of the second piston-cylinder arrangement 56, a shown in FIGS. 2 and 3. Furthermore, when the support surface 66 of the piston-cylinder arrangements 56 and 58 are in their lower position, as shown in FIG. 1, ram device 90 automatically moves a test specimen TS from the support surface 66 onto the second track 40*a*, which in turn forces a control specimen CS to be moved from the second track 40*a* onto the support surface 66 of the second piston-cylinder arrangement 58.

Figure 5:
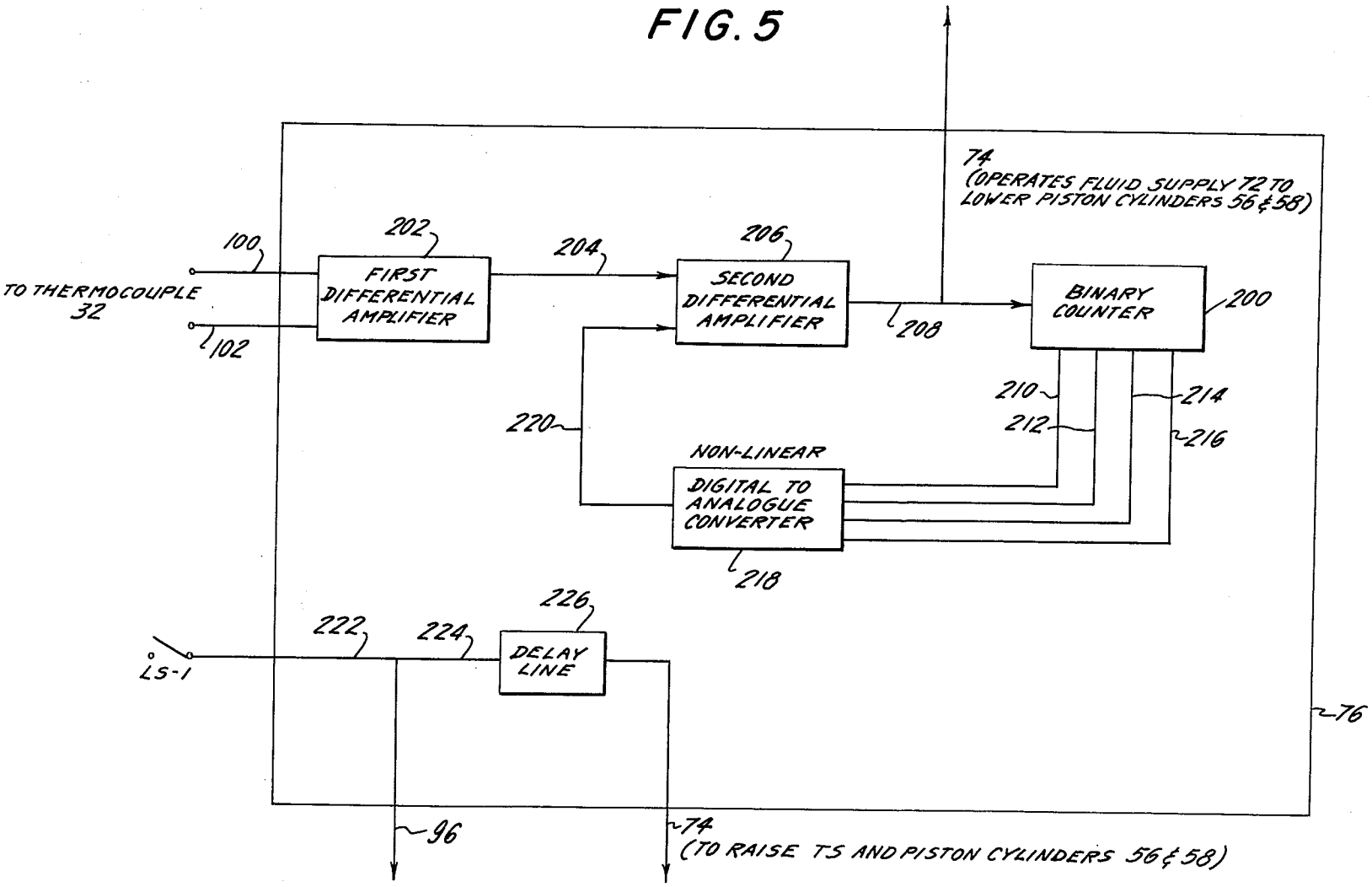
FIG. 5 is a schematic view of the control apparatus employed in the furnace shown in FIG. 1.

The components of control means 76 for synchronizing movement of the first and second piston-cylinder arrangements 56, 58 are conventional components as will be apparent to one skilled in the art. For example, control means 76, as shown in FIG. 5, may include a binary counter 200 which is preset at values corresponding to each of the predetermined temperatures at which the specimens in the heating zone are to be heated. The binary counter 200 is linked to the thermocouple 32 through lines 100, 102, which lines connect to a first differential amplifier 202 which is in turn linked through line 204 to a second differential amplifier 206. The second differential amplifier 206 is linked to the binary counter 200 via line 208. The first differential amplifier 202 converts the signals received from the thermocouple 32, which signals correspond to the temperature at which the test specimens are heated to in the heating zone, to a single signal which is fed via line 204 to the second differential amplifier 206. Control means 76 also includes means for comparing the signal transmitted from the first differential amplifier 202 to the second differential amplifier 206 with a signal corresponding to a predetermined temperature at which the test specimens are to be heated. In order to effect such comparison, binaary counter 200 is linked via lines 210, 212, 214 and 216 to a digital-/analogue converter 218, the output of which is linked by line 220 to the second differential amplifier 206. The second differential amplifier 206 functions to compare the signal received from line 204, (that is, corresponding to the signal transmitted by the thermocouple 32) and the signal received via line 20 (which corresponds to the preset predetermined temperature). When the signal in line 204, hereinafter referred to as signal 204, exceeds the signal in line 220, hereinafter referred to as signal 220, the second differential amplifier 206 supplies a signal corresponding to such difference, which signal is fed via line 74 to the fluid supply 72 wherein solenoid valves are activated to cause liquid in fluid supply 72 to flow via lines 70 and 68, respectively, back to the piston-cylinder arrangements 56, 58 thereby causing the support surfaces 66 to move to their upper positions, as shown in FIG. 2. When the piston-cylinder 58 is raised to its upper position, the surface 66 thereof contacts a limit switch LS-2 which activates a solenoid valve in fluid supply 84 causing the piston-cylinder device 90 to move the control specimen CS-1 resting one the surface 66 of piston-cylinder 58 into heating zone 24 which in turn causes the first test specimen TS-1 to be moved out of heating zone 24 onto the surface 66 of the piston-cylinder 56 since all the specimens are in contact with each other. The piston of the piston-cylinder device 80 is also spring-biased so that as soon as the control specimen has been moved into heating zone 24, the piston portion thereof moves back into its retracted position, as shown in FIG. 2. When the piston-cylinders 56 and 58 move to their lower positions, binary counter 200 automatically advances to the next predetermined temperature so as to raise the voltage level corresponding to signal 220 to that which corresponds to the next predetermined temperature at which the test specimens in the heating zone are to be heated. When the piston-cylinders 56 and 58 move to their lower positions, the piston-cylinder 56 closes limit-switch LS-1 causing activation of a solenoid valve in fluid supply 94 thereby causing operation of the piston-cylinder device 90 which causes the test specimen TS-1 removed from heating zone 24 to be moved from the surface 66 of the piston-cylinder 56 into cooling zone 36. Movement of the test specimen TS-1 into cooling zone 36, causes control specimen CS-2 to be pushed onto the surface 66 of the piston-cylinder 58, since all the specimens are in contact with each other. The piston 90 is preferably spring-biased so that as soon as the test specimen on the surface 66 is moved into the cooling zone, the piston cylinder 90 returns to its initial position, as shown in FIG. 4. The limit switch LS-1 is connected via lines 222 and 224 to a delay line 226 which in turn is connected to fluid supply 72 via line 74, as shown. The delay line 226 functions to allow the piston-cylinder 90 sufficient time to push the test specimen from the surface 66 into cooling zone 36 before the piston-cylinders 56 and 58 are raised to their upper position, as shown in FIG. 2 as well as in FIG. 4. After the test specimen has been removed from the surface 66 of piston-cylinder 56, the delay line 226 develops a pulse which is fed via line 74 to solenoid valves of fluid supply 72 thereby causing fluid to flow into the piston-cylinders 56 and 58 to raise the same to their upper positions.

In employing the furnace of the present invention as described above for preparing test specimens, for example, ceramic specimens, a plurality of ceramic test specimens TS-1 to TS-10 are disposed on track 28*a*, end to end, in heating zone 24 so that the specimens contact each other, as shown in FIG. 1. The piston rods 64 of the piston-cylinder arrangements 56 and 58 at the beginning of a cycle are in their lower positions, as shown by the solid lines in FIG. 1, with piston-cylinder arrangement 58 having a control specimen CS-1 situated thereon ready to be transferred to heating zone 24. In addition, a series of control or blank specimens CS-2 to CS-11 are disposed from end to end in contact with each other along the length of second track 40*a* in cooling zone 36, as shown in FIG. 1.

The heating element 26 is activated so as to uniformly heat the heating zone 24 to a first predetermined temperature. The specimen TS-1 disposed on the first specimen support means 28 below thermocouple 32 and specimens TS-2 to TS-10 are all heated to said first predetermined temperature, with the binary counter 200 of control means 76 being set at said first predetermined temperature. Thermocouple 32 transmits signals to firsts differential amplifier 202 which signals are converted into a single signal 204 which is fed to second differential amplifier 206. When such a signal 204 exceeds the comparison signal 220 which corresponds to the first predetermined temperature, the second differential amplifier 206 feeds a signal via line 74 to the fluid supply 72 to open the solenoid valves therein to cause fluid to flow to the cylinders 60 of the piston-cylinders 56 and 58 thereby causing pistons 62, piston rods 64 and support surfaces 66 of piston-cylinders 56 and 58 to be moved into their upper positions, as shown in FIG. 2. Limit Switch LS-2 is thereby closed causing piston-cylinder device 80 to move control specimen CS-1 from the surface 66 of piston-cylinder 58 onto track 28*a* into heating zone 24 which in turn causes test specimen TS-1 to be moved onto the surface 66 of piston-cylinder 56. Delay line 226 thereafter causes solenoid valves of fluid supply 72 to open and allow fluid to flow back to fluid supply 72 to lower same to their lower positions. Limit Switch LS-1 is then closed causing piston-cylinder device 90 to move test specimen TS-1 into cooling zone 36 and causing the second control specimen CS-2 to move onto surface 66 of piston cylinder 58, as shown in FIG. 3.

It will be appreciated that the above sequence of events is repeated for each preset predetermined temperature until the last test specimen TS-10 has been lowered to cooling zone 36 (see FIG. 4).

When the heat treatment in heating zone 24 comprises preparing test specimens at the same temperature for different periods of time, control means 76 is modified to include a timing device corresponding to the binary counter wherein such timing device is preset at the desired different number of heat treatment times so that after each heat treatment period, the sequence of events as described above with respect to the heat treatment of the test specimens at different temperatures, will similarly occur.

All of the components of control means 76 are conventional aand by themselves form no part of the present invention. Thus, the differential amplifiers as well as the digital-analogue converter and the binary counter are all of conventional construction as will be apparent to one skilled in the art.

In an alternative embodiment, the thermocouple 32 may comprise a cam-operated thermocouple which is employed to activate an electric motor in control means 76 which electric motor automatically operates pumps leading to the various fluid supplies as shown in the Figures. The electric motor would operate on a predetermined time-temperature cycle depending on the type of heat treatment desired.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A method of preparing test specimens subjected to heating for different time periods, which comprises feeding at least first and second test specimens to be prepared into a heating zone; heating said test specimens at a predetermined temperature for a predetermined period of time; removing said first test specimen from said heating zone, said first test specimen representing a specimen heated to said predetermined temperature for said predetermined time period; substantially simultaneously feeding a first control specimen into said heating zone to replace said first test specimen, thereby maintaining constant the total number and/or mass of specimens present in said heating zone; heating said second test specimen and said first control specimen at said predetermined temperature for an additional predetermined period of time; and thereafter removing said second test specimen from said heating zone, said second test specimen representing a test specimen heated at said predetermined temperature, under the same conditions as was said first test specimen for said predetermined period of time, as well as for said additional predetermined period of time.

2. The method in accordance with claim 1 further including the steps of sensing the degree of said first heat treatment and when the desired degree of heat treatment is sensed, automatically removing said first test specimen from said heating zone and transferring it to a cooling zone, and automatically feeding said first control specimen from said cooling zone into said heating zone to replace said first test specimen.

3. The method in accordance with claim 1 further including the step of pre-heating said first control specimen before feeding it into said heating zone.

4. The method in accordance with claim 1 wherein the step of removing said first test specimen from said heating zone includes the step of moving said first control specimen into said heating zone, the movement of said first control specimen into said heating zone causing movement of said first test specimen out of said heating zone.

5. The method in accordance with claim 4 wherein the step of moving said first control specimen into said heating zone includes the step of simultaneously displacing said second test specimen to cause the movement of said first test specimen out of said heating zone.

6. The method in accordance with claim 2 wherein the step of transferring said first test specimen to said cooling zone includes the step of moving said first test specimen into said cooling zone, the movement of said first test specimen into said cooling zone causing movement of a second control specimen out of said cooling zone.

7. The method in accordance with claim 1 wherein said test specimens comprise ceramic specimens.

8. A furnace for preparing test specimens subjected to heat treatment comprising, in combination: a furnace chamber including a heating zone; heating means for heating said heating zone; first specimen support means disposed in said heating zone for supporting at least two test specimens to be subjected to heat treatment; heat sensing means disposed in said heating zone for sensing the degree of heat treatment of at least one of said test specimens; means for removing from said heating zone at least one test specimen subjected to a predetermined heat treatment; and means for substantially simultaneously feeding control specimens into said heating zone to maintain constant the total number of specimens subjected to heat treatment in said heating zone, said heat-sensing means being in operative communication with said removing means to actuate operation of said removing means when said heat-sensing means senses that a test specimen has been heated to a predetermined temperature for a predetermined period of time so that said test specimen may be removed from said heating zone.

9. The furnace in accordance with claim 8 wherein said first specimen support means comprises a first track having first and second ends and is adapted to support a plurality of said test and/or control specimens along the length of said first track as said specimens are subjected to heat treatment.

10. The furnace in accordance with claim 9 further including a cooling zone disposed in said chamber and insulated from said heating zone, said cooling zone including second specimen support means for supporting control specimens and test specimens previously subjected to heat treatment.

11. The furnace in accordance with claim 10 wherein said second specimen support means disposed in said cooling zone comprises a second track having first and second ends and is adapted to support a plurality of said control and/or test specimens along the length of said second track for storing of said control specimens and for cooling of said test specimens previously subjected to heat treatment

12. The furnace in accordance with claim 11 wherein said removing means includes specimen outlet conveyor means comprising a first piston-cylinder arrangement disposed in proximity to said first end of said first track, and said feeding means includes specimen inlet conveyor means comprising a second piston-cylinder arrangement disposed in proximity to said second end of said first track, each of said piston-cylinder arrangements including a piston rod and support means connected to said piston rod for supporting a control or test specimen as said specimen is moved relative to said heating zone and further including drive means for operating said first and second piston-cylinder arrangements.

13. The furnace in accordance with claim 12 further including first ram means disposed in proximity to said second end of said first track for moving a control specimen from said support means of said second piston-cylinder arrangement onto said first track and into said heating zone; and second ram means disposed in proximity to said first end of said second track for moving a test specimen from said support means of said first piston-cylinder arrangement onto said second track and into said cooling zone; and drive means for operating said first and second ram means.

14. The furnace in accordance with claim 13 wherein said heat sensing means is in operative communication with said drive means for operating said first and second piston-cylinder arrangements and said drive means for operating said first and second ram means.

15. The furnace in accordance with claim 8 wherein said heat sensing means is in operative communication with said feeding means and is further adapted to control operation of said feeding means to feed a control specimen into said heating zone to replace a previously removed test specimen to thereby maintain constant the total number of specimens subjected to heat treatment in said heating zone.

16. The furnace in accordance with claim 15 wherein said removing means include specimen outlet conveyor means comprising a first piston-cylinder arrangement disposed in proximity to said first end of said first track, and said feeding means includes specimen inlet conveyor means comprising a second piston-cylinder arrangement disposed in proximity to said second end of said first track, each of said piston-cylinder arrangements including a piston rod and support means connected to said piston rod for supporting a control or test specimen as said specimen is moved relative to said heating and cooling zones, and further including drive means for operating said first and second piston-cylinder arrangements.

17. The furnace in accordance with claim 8 wherein said heat sensing means comprises a thermocouple.

* * * * *